United States Patent [19]

Miller et al.

[11] 4,414,263

[45] Nov. 8, 1983

[54] PRESS FELT

[75] Inventors: Joseph S. Miller; Ronald L. Aylor, both of Atlanta, Ga.

[73] Assignee: Atlanta Felt Company, Inc., Battlecreek, Ga.

[21] Appl. No.: 396,626

[22] Filed: Jul. 9, 1982

[51] Int. Cl.[3] ..... B32B 5/00

[52] U.S. Cl. ..... 428/234; 139/383 A; 162/DIG. 1; 162/358; 428/255; 428/257; 428/258; 428/280; 428/300

[58] Field of Search ..... 162/DIG. 1, 358; 428/234, 247, 257, 258, 300, 280, 255; 139/383 A

[56] References Cited

U.S. PATENT DOCUMENTS

| | | | |
|---|---|---|---|
| 3,093,880 | 6/1963 | McLaughlin | 162/DIG. 1 |
| 3,214,327 | 10/1965 | Wicker et al. | 162/DIG. 1 |
| 4,107,367 | 8/1978 | Fekete | 428/300 |
| 4,290,209 | 9/1981 | Buchanan et al. | 34/116 |
| 4,351,874 | 9/1982 | Kirby | 428/257 |

*Primary Examiner*—James J. Bell

[57] ABSTRACT

The invention relates to a press felt which is in the shape of an endless belt and which has opposed side edges. The lateral direction of the belt extends between the side edges, and the longitudinal direction extends perpendicular to the lateral direction. The felt comprises an open-mesh base fabric woven of a plurality of synthetic filaments extending in both the lateral and longitudinal directions, and at least one batt of staple fibers needled thereto. In accordance with the invention, at least some of the filaments extending in the lateral direction are monofilaments having a flattened cross-section, the long axis of the flattened cross-section lying in a plane parallel to the plane of the fabric.

6 Claims, 5 Drawing Figures

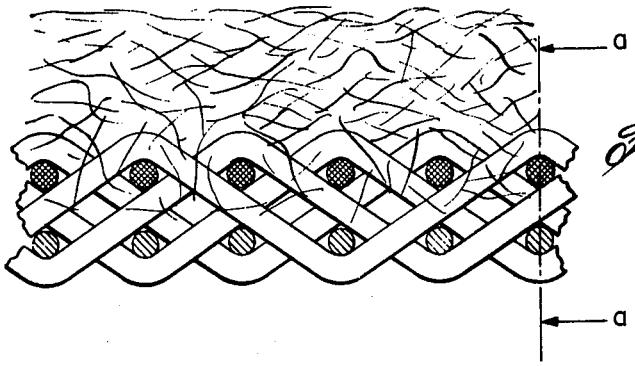
Fig. 3A (PRIOR ART)
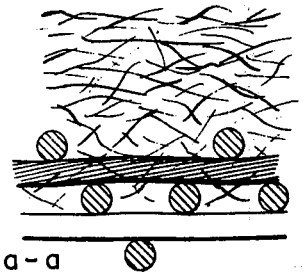
Fig. 3B
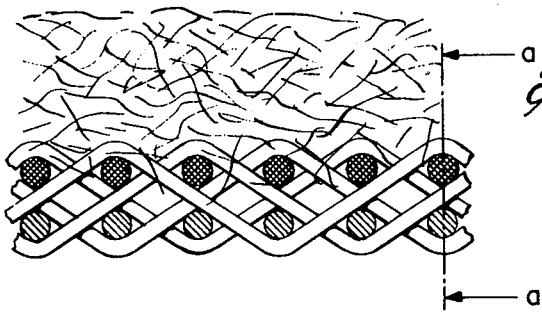
Fig. 4A
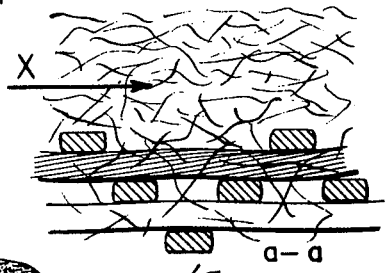
Fig. 4B
Fig. 5
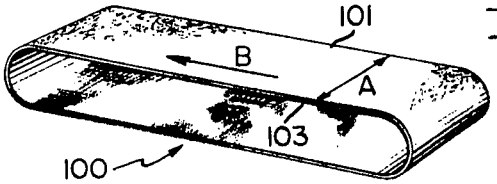

PRESS FELT

BACKGROUND OF INVENTION (a) Field of the Invention

This invention relates to needled felts used in the press section of a paper making machine and is particularly directed to the provision of an improved base fabric for a wet felt having a batt of fibers needled thereto.

(b) Description of Prior Art

In the continuous manufacture of paper from a pulp suspension, the paper machine comprises essentially a forming section, a press section and a dryer section. In the forming section a thin suspension of fibers and fillers, containing generally about 99.5% water, is flowed from a headbox slice at the upstream end onto the surface of a moving endless screen belt or forming fabric which is made of woven metal or plastic filaments. The forming fabric passes over various devices which withdraw some of the water from the pulp stock, leaving on the fabric a thin self-supporting web of matted fibers containing about 75 to 80 percent water.

The web of fibers is lifted off the forming fabric at the downstream end of the forming section and is transferred to a press section where it is deposited on a series of endless belts of relatively thick, permeable, water-absorbing felt and is passed on these felts between one or more sets of press rolls where some of the water remaining in the web of paper is transferred to the felts by pressure.

After emerging from the press section and containing about 60 to 65% water, the paper web is then transferred to a dryer section where it runs in serpentine fashion over a number of steam heated rolls and the remaining moisture in the web is driven off by evaporation.

The evaporation of the 60% of moisture remaining in the paper web is a costly process as it requires a considerable amount of energy in the form of steam. It will be appreciated that if more water is removed from the web in the press section, less steam will be required in the dryer section. For example, in a machine producing 600 tons of heavy paper a day, a reduction in moisture content of only 2 percent in the web delivered to the dryer section will result in a saving of 216,000 pounds of steam each day. In terms of money this will amount to a daily saving of about $540.

Water removal in the press section is effected by the use of a smooth surfaced, perhaps rubber covered, top roll bearing under pressure against a grooved, perforated or mesh covered bottom roll which provides receptacles for water expressed from the paper web and felt as they pass between the rolls. The felt, which is compressible and resilient, acts as an intermediary between the water receptacles and the paper web. A generally accepted theory is that as the paper web and felt approach the maximum nip between the press rolls, water is squeezed from the paper to the felt. At the maximum nip the compressed felt has reached the saturation point resulting in the flow of water from the felt into the receptacles in the roll under the felt. After passing the maximum nip the resilient felt expands, the paper is further compressed until it reaches a state of maximum dryness, then, as air and water from the receptacles in the roll enter the expanding felt, a negative pressure is created in both paper and felt and, while the felt will retain most of the water some will be reabsorbed by the paper. Water is removed from the felt by passing it over a suction box and residual water is removed from the bottom press roll by centrifugal action and/or by a doctor.

An ideal press felt should provide perfectly uniform pressure distribution, the lowest possible resistance to flow of water through the felt, perpendicularly and in the machine direction, and compressibility and resilience so that it will have full elastic recovery after passing through the press nip in order to minimize re-wetting of the paper web. In addition to these water extraction efficiency factors, the ideal press felt should have a smooth, non-marking paper contacting surface and sufficient strength and stability to prevent length and width variations and wrinkling during operation.

A conventional type of felt that most nearly approaches this ideal consists of an openmesh base fabric woven with synthetic monofilaments or multifilaments, or a combination of these, to which is needled one or more batts of staple fibers. The base fabric should have low compressibility to maintain integrity and may be single layer or socalled double or multi-layer fabric having two or more layers of weft. The base fabric is generally woven endless so that when the felt is installed on the machine the weft is continuous and extends in the running direction; the warp extending in the cross-machine direction.

Examples of prior art press felts are described and illustrated in U.S. Pat. Nos. 3,214,327, Wicker et al, and 4,107,367, Fekete.

When the web travels through the dryer section, it is also carried by an endless belt. One such endless belt is taught and illustrated in U.S. Pat. No. 4,290,209, Buchanan et al. In the dryer fabric illustrated in the '209 patent, at least the warp strands are flattened in cross-section.

SUMMARY OF THE INVENTION

The aim of the present invention is to improve on the conventional felt of the prior art and provide one having advantages which will be outlined in the following description.

In accordance with the invention, there is provided a press felt being in the shape of an endless belt and having opposed side edges. The felt has a lateral direction which extends between the side edges thereof, and a longitudinal direction extending perpendicularly to the lateral direction. The felt comprises an open-mesh base fabric woven of a plurality of synthetic filaments extending in both the lateral and longitudinal directions, and at least one batt of staple fibers needled thereto. In accordance with the invention, at least some of the filaments extending in the lateral direction are monofilaments having a flattened cross-section, the long axis of which is parallel to the plane of the fabric.

Important features provided by the flattened monofilament yarns of the base fabric of the invention are now enumerated:

1. The base fabric resists compaction in thickness due to roll pressure because the loading at the cross-overs of yarns of the fabric is spread over lines of contact rather than points of contact.

2. The flattened monofilaments offer less resistance to flow of water in the machine direction than round monofilaments having the same cross-sectional area.

3. A more compressible batt providing higher void volume may be used without danger of marking the web of paper with the knuckles of warp yarns.

The above features relate to improved water extraction efficiency.

4. The knuckles are less prominent and marking of the web of paper through the compressed batt is reduced.

This relates to improved quality in the finished paper.

5. The felt is more pliable in the cross-machine direction compared with felts having base fabrics woven with round cross-machine monofilaments of the same cross-sectional area. The felt is therefore easier to install on the machine.

6. The break-in period of the felt is substantially reduced. A new conventional felt requires a prolonged break-in period during which the machine must be run at reduced speed until the felt becomes stabilized at a reduced thickness and improved surface smoothness. Use of the flattened yarns in the base fabric inherently provides these conditions.

These features relate to greater efficiency in the machine operation.

7. The flattened monofilaments provide better contact between yarns at cross-overs which helps to stiffen the fabric against diagonal distortion.

This feature is generally beneficial to the strength and life span of the felt.

8. The flattened warp monofilaments are easier to weave than equivalent round monofilaments because of reduced sectional modulus. This feature is an advantage enabling the base fabric to be woven on old style conventional looms.

BRIEF DESCRIPTION OF DRAWINGS

Preferred embodiments of the present invention will now be described with reference to the examples illustrated in the accompanying drawings in which:

FIG. 3A is an enlarged sectional view of a portion of press felt illustrating circular warp strands in a conventional duplex base fabric;

FIG. 3B is a sectional view taken along section line a—a of FIG. 3A;

FIG. 4A is an enlarged sectional view of a press felt with a duplex base fabric made according to the present invention;

FIG. 4B is a sectional view taken along section line a—a of FIG. 4A; and FIG. 5 is a perspective view of the press felt.

DESCRIPTION OF PREFERRED EMBODIMENTS

Figure 1A:
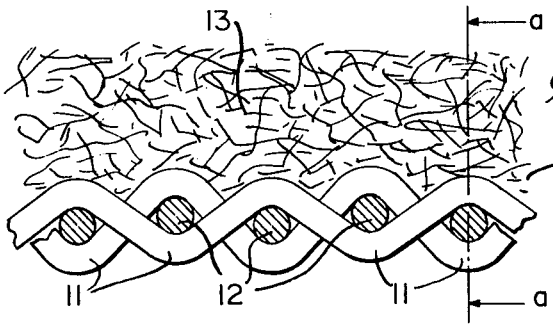
Fig. 1a (PRIOR ART)
FIG. 1A is an enlarged sectional view of a portion of press felt illustrating circular warp strands in a plain woven base fabric as presently utilized.
Figure 1B:
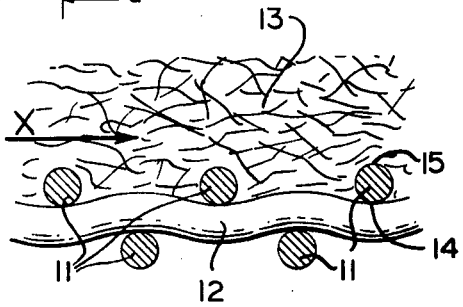
Fig. 1B (PRIOR ART)
FIG. 1B is a sectional view taken along section line a—a of FIG. 1A.

Referring first to FIG. 5, a press felt, indicated generally at 100, is in the shape of an endless belt and has opposed side edges 101 and 103. For purposes of the present disclosure, the lateral direction of the belt, arrow A, is the direction which extends between the side edges. The longitudinal direction, indicated at arrow B, is the direction perpendicular to the lateral direction.

As is known in the art, such endless belts can be prepared by interweaving a plurality of synthetic filaments so that some of the filaments extend in the lateral direction and some of the filaments extend in the longitudinal direction. The felt can be woven as an endless belt in which case the filaments extending in the longitudinal direction are the weft filaments whereas the filaments extending in the lateral direction are the warp filaments. The belts can also be woven flat (for large machines) and then joined together at their ends. In this case, the filaments extending in the longitudinal direction are the warp filaments whereas the filaments extending in the lateral direction are the weft filaments.

In FIGS. 1 to 4 below, the description is based on a fabric which is woven as an endless belt. Accordingly, the warp filaments are the filaments which extend in the lateral direction. In accordance with the invention, it is the filaments which extend in this lateral direction which are modified to improve the performance of the felt.

As is also obvious, the longitudinal direction of the felt corresponds with the machine direction of the press section, whereas the lateral direction of the felt corresponds with the cross machine direction of the press section.

Attention is now directed to FIGS. 1 to 4 of the drawings. FIGS. 1A and 1B show generally a press felt 10 having a plain woven base fabric of the prior art in which numeral 11 denotes consecutive round synthetic warp monofilaments and numeral 12 denotes consecutive synthetic weft monofilaments. Numeral 13 denotes a batt of fibers that is needled to the base fabric. In this structure each warp strand 11 passes over a first weft strand 12, under a second weft strand, over a third and so on. Similarly the adjacent warp strand passes under the first weft strand, over the second, under the third and so on.

Figure 2A:
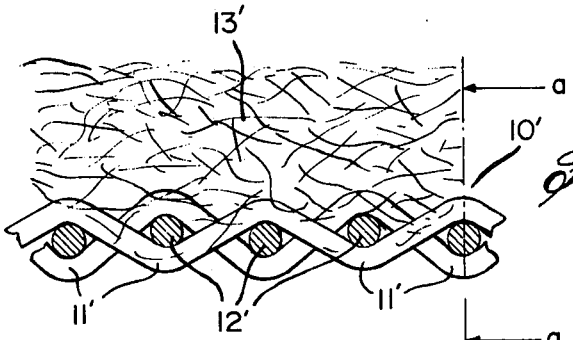
FIG. 2A is an enlarged sectional view of a portion of press felt with a plain woven base fabric according to the present invention.
Figure 2B:
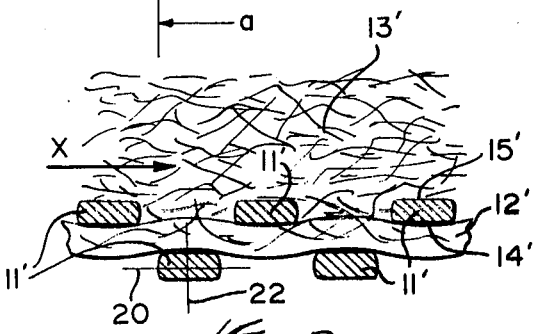
FIG. 2B is a sectional view taken along section line a—a of FIG. 2A.

FIGS. 2A and 2B show the same fabric structure 10' as in the FIG. 1 but woven with synthetic warp monofilaments 11' having about the same cross-sectional area but flattened to the extent that the short axis 22 is only one-half of the long axis 20. Numeral 12' denotes the weft and numeral 13' denotes the batt of needled fibers.

In comparing the base fabrics of FIGS. 1 and FIGS. 2 it will be apparent that the fabric made with the flattened warp is thinner and therefore more pliable in the warp direction. The lower profile of the flattened warp will offer less resistance to the flow of water in the weft, or machine, direction indicated by the arrow X. The line contact shown at cross-over 14' is more stable than the point contact shown at cross-over 14.

Also, the flattened knuckles 15' will not protrude through the batt as readily as will be round contoured knuckles 15 when the felt is subjected to pressure between press rolls.

FIGS. 3 and 4 show a similar comparison when the synthetic base fabric is a 4-shaft 8 repeat duplex structure having monofilament wefts in the lower weft layer and multifilament wefts in the upper layer. It will be apparent when comparing the structure of the conventional base fabric of FIGS. 3 with that of FIGS. 4 that the same advantages shown in the comparison of FIGS. 1 and 2 will be realized.

The base fabric of the invention will have synthetic monofilament warp strands having a cross-sectional area between 0.07 and 0.50 square mm and flattened to the extent that the ratio of the long axis to the short axis will be in the range of from 1.2:1 to 3:1. A preferred warp monofilament will have a cross-sectional area of about 0.18 square mm and a flatness ratio within the range 1.8:1 to 2.2:1. The flattened monofilament need not have a perfectly rectangular cross-section.

It is not intended to limit the base fabric of the invention to any particular synthetic material or weave structure. While a preferred structure would be a duplex weave with upper layer multifilament wefts and lower layer monofilament wefts as shown in FIG. 4, the fabric may have only multifilament or staple fiber weft or only monofilament weft or any combination of these.

The base fabric may be single layer or multi-layer and the batt or batts may be any known fibrous material needled into the fabric by any known method and may be treated in any known manner.

Although the description in FIGS. 1 to 4 teaches flattened warp filaments, it will be understood that if the felt is made flat and then joined at the ends, it will be the weft filaments which are flattened. Basically, the flattened filament is always the filament which extends in the lateral direction of the completed felt.

Although several embodiments have been described, this was for the purpose of illustrating, but not limiting, the invention. Various modifications which will come readily to the mind of one skilled in the art are within the scope of the invention as defined in the appended claims.

We claim:

1. A press felt being in the shape of an endless belt and having opposed side edges, said felt having a lateral direction extending between the side edges thereof and a longitudinal direction extending perpendicularly to said lateral direction, said felt comprising an open-mesh base fabric woven of a plurality of synthetic filaments extending in both the lateral and longitudinal directions, and at least one batt of stable fibers needled thereto, characterized in that at least some of the filaments extending in the lateral direction are monofilaments having a flattened cross-section, the long axis of which lies parallel to the plane of the fabric.

2. A press felt as defined in claim 1 wherein said lateral monofilaments have a cross-sectional area between 0.07 and 0.50 square mm, said lateral monofilaments being flattened to the extent that the ratio of the long axis to the short axis will be in the range of 1.2:1 to 3:1.

3. A press felt as defined in claim 2 wherein said lateral monofilaments have a cross-sectional area of 0.18 square mm and wherein the ratio of the long axis to the short axis is in the range of 1.8:1 to 2.2:1.

4. A press felt as defined in any one of claims 1, 2 or 3 wherein said lateral monofilaments are plastic polymeric monofilaments.

5. A press felt as defined in any one of claims 1, 2 or 3 wherein said felt is woven as an endless belt and wherein said lateral filaments comprise the warp filaments thereof.

6. A press felt as defined in any one of claims 1, 2 or 3 wherein said press felt is woven as a flat layer and joined at the ends thereof to form said endless belt, and wherein said lateral filaments comprise the weft filaments thereof.

* * * * *